US009695719B2

(12) United States Patent
Arai

(10) Patent No.: US 9,695,719 B2
(45) Date of Patent: Jul. 4, 2017

(54) EXHAUST MUFFLER DEVICE FOR COMBUSTION ENGINE

(71) Applicant: Kawasaki Jukogyo Kabushiki Kaisha, Hyogo (JP)

(72) Inventor: Kozo Arai, Chonburi (TH)

(73) Assignee: KAWASAKI JUKOGYO KABUSHIKI KAISHA, Hyogo (JP)

( * ) Notice: Subject to any disclaimer, the term of this patent is extended or adjusted under 35 U.S.C. 154(b) by 0 days.

(21) Appl. No.: 14/854,644

(22) Filed: Sep. 15, 2015

(65) Prior Publication Data

US 2016/0084127 A1 Mar. 24, 2016

(30) Foreign Application Priority Data

Sep. 24, 2014 (JP) ..... 2014-193601
Sep. 24, 2014 (JP) ..... 2014-193602

(51) Int. Cl.
*F01N 1/16* (2006.01)
*F01N 1/08* (2006.01)

(52) U.S. Cl.
CPC ..... *F01N 1/166* (2013.01); *F01N 1/084* (2013.01); *F01N 2470/14* (2013.01); *F01N 2590/04* (2013.01)

(58) Field of Classification Search
CPC ..... F01N 1/163; F01N 1/166; F01N 1/084; F01N 2470/14; F01N 2590/04
USPC ..... 181/254, 282
See application file for complete search history.

(56) References Cited

U.S. PATENT DOCUMENTS 4,484,659 A * 11/1984 Buchwalder ..... F01N 1/02 181/237
5,614,699 A * 3/1997 Yashiro ..... F01N 1/02 181/254
5,984,045 A * 11/1999 Maeda ..... F01N 1/02 181/254
6,065,564 A * 5/2000 Uegane ..... F01N 1/084 181/237
7,282,185 B2 * 10/2007 Harris ..... B01D 53/9454 181/249
7,895,832 B2 * 3/2011 Gruber ..... F01N 1/02 181/227
8,851,231 B1 * 10/2014 Murphy ..... F01N 1/083 181/237
2005/0155816 A1 * 7/2005 Alcini ..... F01N 1/163 181/237

(Continued)

FOREIGN PATENT DOCUMENTS

JP 2011-117412 6/2011

*Primary Examiner* — Jeremy Luks

(57) ABSTRACT

An exhaust muffler device for an combustion engine includes: a first expansion chamber into which exhaust gas from a combustion engine flows; a second expansion chamber disposed downstream of the first expansion chamber; a resonance chamber that is disposed adjacent to the first expansion chamber and communicates with an exhaust passage; a discharge passage through which the exhaust gas that flows into the resonance chamber is discharged to the outside; and an exhaust valve disposed in a second partition wall between the first expansion chamber and the resonance chamber. The exhaust valve opens when pressure in the first expansion chamber attains a value greater than a predetermined value.

11 Claims, 6 Drawing Sheets

(56) References Cited

U.S. PATENT DOCUMENTS

| | | | | |
|---|---|---|---|---|
| 2008/0245605 | A1* | 10/2008 | Maeda | F01N 1/084<br>181/254 |
| 2009/0000862 | A1* | 1/2009 | Buell | F01N 1/083<br>181/212 |
| 2010/0126159 | A1* | 5/2010 | Han | F01N 1/083<br>60/324 |
| 2010/0126799 | A1* | 5/2010 | Matsueda | F01N 1/083<br>181/271 |
| 2011/0048848 | A1* | 3/2011 | Han | F01N 1/083<br>181/228 |
| 2011/0079463 | A1* | 4/2011 | Scheetz | F01N 1/02<br>181/250 |
| 2014/0060963 | A1* | 3/2014 | Ono | F01N 1/089<br>181/228 |
| 2014/0166392 | A1* | 6/2014 | Kye | F01N 13/1894<br>181/226 |

* cited by examiner

EXHAUST MUFFLER DEVICE FOR COMBUSTION ENGINE

CROSS REFERENCE TO THE RELATED APPLICATION

This application is based on and claims Convention priority to Japanese patent application Nos. 2014-193601 and 2014-193602, filed Sep. 24, 2014, the entire disclosure of which is herein incorporated by reference as a part of this application.

BACKGROUND OF THE INVENTION

Field of the Invention

The present invention relates to an exhaust muffler device having two or more expansion chambers into which exhaust gas from a combustion engine flows.

Description of Related Art

An exhaust muffler device having a plurality of expansion chambers has been known in which an exhaust valve is provided to bypass a portion of exhaust gas, from the expansion chamber on the upstream side, to the expansion chamber on the downstream side, in order to protect the exhaust muffler device from high-pressure exhaust gas (for example, JP Laid-open Patent Publication No. 2011-117412).

In the exhaust muffler device described in JP Laid-open Patent Publication No. 2011-117412, when an exhaust valve is opened, exhaust gas that flows in a main passage and exhaust gas that flows in a bypass passage are merged in an expansion chamber on the downstream side, and the merged exhaust gas is discharged to the outside through a discharge pipe. In a case where the discharge pipe has a large diameter, muffling effect or silencing effect may not be sufficient when the exhaust valve is closed. On the other hand, in a case where the discharge pipe has a small diameter, engine output may be reduced when the valve is opened, or internal pressure in the expansion chamber on the downstream side may be excessive when the valve is opened.

SUMMARY OF THE INVENTION

An object of the present invention is to provide an exhaust muffler device, for an engine, which allows muffling effect to be sufficient when an exhaust valve is closed, and allows engine output to be assured when the valve is opened.

In order to accomplish the above object, an exhaust muffler device of the present invention includes an expansion chamber into which exhaust gas in a combustion engine flows. The exhaust muffler device includes: an exhaust passage configured to discharge the exhaust gas through the expansion chamber to an outside of the exhaust muffler device; a muffler chamber disposed adjacent to the expansion chamber; a discharge passage configured to discharge the exhaust gas from the muffler chamber to the outside of the exhaust muffler device; and an exhaust valve, disposed in a partition wall between the expansion chamber and the muffler chamber and configured to open when pressure in the expansion chamber attains a value greater than a predetermined value.

In the description herein, the "expansion chamber" refers to a space which forms a portion of the exhaust passage, in which the exhaust gas is expanded, diffracted, and diffused due to the cross-sectional area of the exhaust passage being rapidly increased, and is caused to collide with walls of the expansion chamber, thereby to be diffusely reflected and attenuated. Further, a "resonance chamber" refers to a space in which, during traveling of sound wave of the exhaust gas between the resonance chamber and the exhaust passage, energy of the exhaust gas is attenuated due to interference of the sound waves, thereby to convert the energy of the sound waves to thermal energy, unlike the expansion chamber that forms a portion of the exhaust passage. The resonance chamber may be substantially a space having a dead end so as to allow sound wave to travel in the space, and may have a portion that communicates with another chamber. Further, a "muffler chamber" includes both the expansion chamber and the resonance chamber.

In the above configuration, when pressure in the expansion chamber is increased, the exhaust valve is opened, and a portion of the exhaust gas flows into the muffler chamber. Thus, the exhaust muffler device is protected from the high-pressure exhaust gas. At this time, a portion of the exhaust gas is discharged through the muffler chamber and the discharge passages to the outside, and a remaining portion of the exhaust gas is discharged through the exhaust passage to the outside. That is, in a low pressure state where the exhaust valve is closed, the exhaust gas is discharged through the exhaust passage to the outside. In a high pressure state where the exhaust valve is opened, the exhaust gas is discharged through both the discharge passage and the exhaust passage to the outside. Thus, the exhaust gas can be effectively discharged even when the pressure is high without increasing a diameter of the exhaust passage. As a result, muffling effect can be sufficient when the exhaust valve is closed, and a high engine output can be assured when the valve is opened.

In the present invention, a downstream end portion of the exhaust passage is preferably formed by a first discharge pipe that extends from the expansion chamber through the muffler chamber to communicate with the outside, and a communication hole is preferably formed in a peripheral wall of the first discharge pipe so as to communicate with the muffler chamber. According to this configuration, the muffler chamber can be used as the resonance chamber when the valve is closed. As a result, muffling effect is enhanced when the pressure is low.

In the present invention, when the two or more expansion chambers are provided, the resonance chamber is preferably disposed adjacent to the expansion chamber, on an upstream side, into which the exhaust gas from the combustion engine flows, and preferably communicates with a downstream end portion of the exhaust passage. According to this configuration, the upstream end and the downstream end of the discharge passage communicate with each other through the resonance chamber. Therefore, bypass effect, that the expansion chamber on the downstream side is bypassed, is enhanced.

When the resonance chamber communicates with the downstream end portion of the exhaust passage, it is preferable that a casing is provided in which the two or more expansion chambers and the resonance chamber are formed. In such case, the casing may have a tubular shape having a longitudinal direction, in which the exhaust gas flows into the casing on one end side in the longitudinal direction, the exhaust gas is discharged from the casing on the other end side in the longitudinal direction, and a cross-sectional area is gradually increased from the one end side toward the other end side in the longitudinal direction, and the resonance chamber may be disposed on the other end side in the longitudinal direction. According to this configuration, the capacity of the resonance chamber can be increased without increasing a dimension, of the resonance chamber, in the longitudinal direction. As a result, resonance effect of the resonance chamber is enhanced, while an increase of a dimension, of the exhaust muffler device, in the longitudinal direction is suppressed.

In the present invention, the exhaust valve is preferably disposed in the resonance chamber. According to this configuration, the valve body of the exhaust valve can be prevented from being exposed to exhaust gas having a high temperature.

In the present invention, a portion of the exhaust valve is preferably disposed outside a casing of the exhaust muffler device. According to this configuration, increasing of temperature of the exhaust valve can be suppressed.

In the present invention, a downstream end portion of the exhaust passage is preferably formed by a first discharge pipe that extends from the expansion chamber through the resonance chamber to communicate with the outside. The discharge passage is preferably formed by a second discharge pipe that allows the resonance chamber to communicate with the outside of the exhaust muffler device. A communication hole is preferably formed in a peripheral wall of the first discharge pipe so as to communicate with the resonance chamber. The second discharge pipe is preferably formed so as to cover the first discharge pipe from a radially outer side. An inlet of the second discharge pipe is preferably positioned downstream of the communication hole in the first discharge pipe. According to this configuration, since a double pipe structure is formed by the first discharge pipe and the second discharge pipe, the discharge passage can be made compact. Further, an inlet of the second discharge pipe is positioned downstream of the communication hole in the first discharge pipe. Therefore, when a flow velocity of the exhaust gas that passes in the first discharge pipe is low, exhaust gas introduced through the communication hole into the resonance chamber is less likely to be rapidly discharged from the second discharge pipe to the outside, thereby maintaining resonance effect in the resonance chamber.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims (What is claimed is). In the accompanying drawings, like reference numerals are used to denote like parts throughout the several views, and:

DESCRIPTION OF PREFERRED EMBODIMENTS

Figure 1:
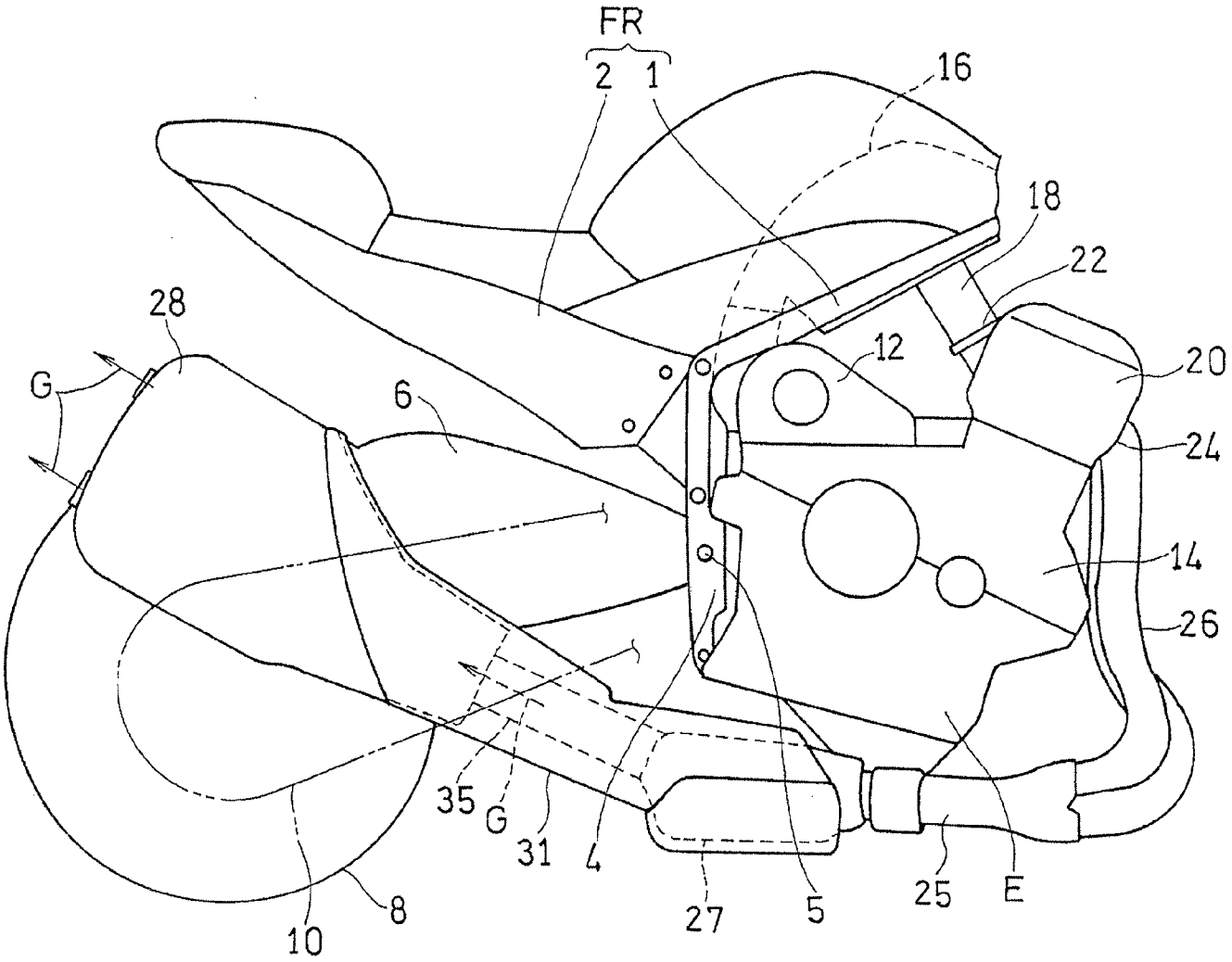
FIG. 1 is a side view illustrating a rear portion of a motorcycle having an exhaust muffler device for a combustion engine according to a first preferred embodiment of the present invention.

Hereinafter, a preferred embodiment of the present invention will be described with reference to the drawings. In the description herein, the left-right direction represents a left-right direction as viewed from a rider riding a motorcycle. FIG. 1 is a side view illustrating a rear portion of a motorcycle having an exhaust muffler device for a combustion engine according to a preferred first embodiment of the present invention. The motorcycle has a vehicle body frame structure FR, and the vehicle body frame structure FR includes a main frame 1 forming a front half thereof and a rear frame 2 forming a rear half thereof, which rear frame 2 is joined to a rear portion of the main frame 1. A front wheel is supported through a front fork assembly (not-illustrated) at the front end portion of the main frame 1.

A swing arm bracket 4 is provided at the lower portion of the rear end of the main frame 1, and a swing arm 6 is supported through a pivot axle 5 by the swing arm bracket 4 so as to be able to swing in the up-down direction or vertical direction. A rear wheel 8 is supported at the rear end portion of the swing arm 6. A combustion engine E is supported by a lower portion of the center portion of the main frame 1, and the rear wheel 8 is driven by the combustion engine E through a power transmission member 10 such as a chain. The combustion engine E is, for example, a parallel multi-cylinder four-cycle combustion engine.

The combustion engine E of the present embodiment has a supercharger 12 mounted thereon. Specifically, the supercharger 12 is disposed above the rear portion of a crank case 14 of the combustion engine E, and intake air pressurized by the supercharger 12 is stored in an intake air chamber 16 disposed above the supercharger 12, and then supplied to the combustion engine E through a throttle body 18 from an air intake port 22 formed on the rear surface of a cylinder head 20 of the combustion engine E.

A plurality of exhaust pipes 26 are connected to an exhaust port 24 disposed in the front portion of the cylinder head 20 of the combustion engine E. Those exhaust pipes 26 are merged into a merging exhaust pipe 25 below the combustion engine E, and is then connected to an exhaust muffler device 28 through an exhaust chamber 27 and an inlet pipe 35. The exhaust muffler device 28 is disposed on the outer side lateral to the rear wheel 8, for example, disposed to the right of the rear wheel 8, and the exhaust chamber 27 and the exhaust muffler device 28 are covered by a cover 31 from the outer lateral side.

Figure 2:
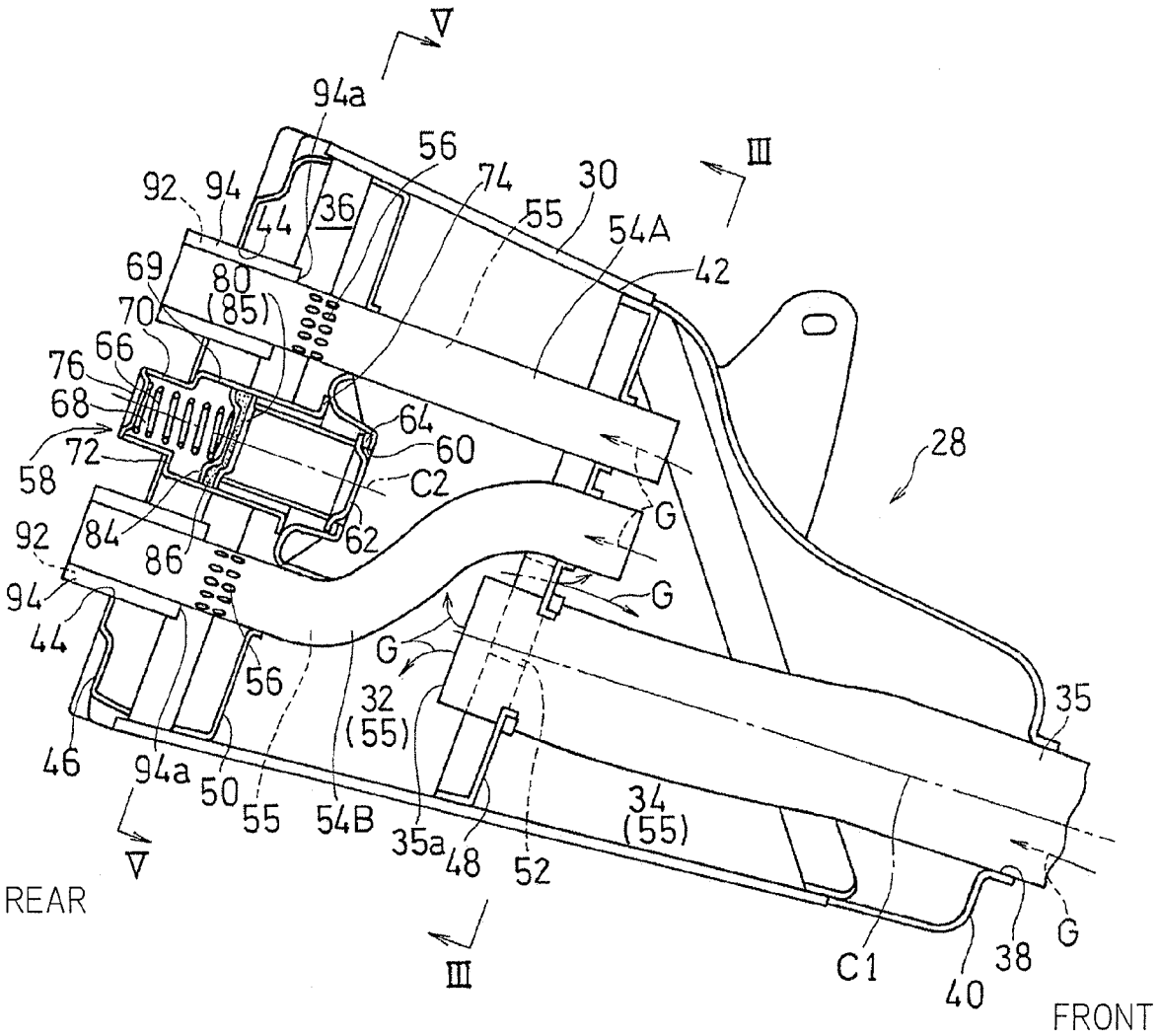
FIG. 2 is a longitudinal cross-sectional view of the exhaust muffler device.

As shown in FIG. 2, the exhaust muffler device 28 has a tubular casing 30 that is elongated in the front-rear direction, which corresponds to a longitudinal direction. Exhaust gas G flows into the casing 30 from the front side, which is one end side in the longitudinal direction of the casing 30, and the exhaust gas G is discharged on the rear side which is the other end side of the casing 30. The casing 30 is formed such that an area of a cross-section that is perpendicular to the longitudinal direction is gradually increased from the front end toward the rear end.

The casing 30 includes therein a first expansion chamber 32 forming an upstream-side expansion chamber into which the exhaust gas G flows, a second expansion chamber 34 disposed downstream of the first expansion chamber 32, and a resonance chamber 36 disposed adjacent to the first expansion chamber 32. The first expansion chamber 32 is formed in the center portion, of the exhaust muffler device 28, in the front-rear direction or the longitudinal direction. The second expansion chamber 34 and the resonance chamber 36 are disposed adjacent to the first expansion chamber 32 on the front side and the rear side, respectively, of the first expansion chamber 32. That is, the resonance chamber 36 is disposed in the rear end portion of the exhaust muffler device 28, and the second expansion chamber 34 is disposed in the front end portion of the exhaust muffler device 28, and the first expansion chamber 32 is disposed between the resonance chamber 36 and the second expansion chamber 34.

Specifically, the casing 30 includes: a front wall 40 having an inlet 38; a peripheral wall 42; and a rear wall 46 having outlets 44, 44. A first partition wall 48 is disposed between the first expansion chamber 32 and the second expansion chamber 34, and is fixed to the peripheral wall 42 by welding. A second partition wall 50 is disposed between the first expansion chamber 32 and the resonance chamber 36, and is fixed to the peripheral wall 42 by welding.

Thus, the second expansion chamber 34 is formed by the front wall 40, the peripheral wall 42 and the first partition wall 48. The first expansion chamber 32 is formed by the first partition wall 48, the peripheral wall 42 and the second partition wall 50. The resonance chamber 36 is formed by the second partition wall 50, the peripheral wall 42, and the rear wall 46.

In the description herein, the "expansion chamber" refers to a space which forms a portion of an exhaust passage 55 described below, in which the exhaust gas G is expanded, diffracted, and diffused due to the cross-sectional area of the exhaust passage 55 being rapidly increased, and is caused to collide with walls of the expansion chamber, thereby to be diffusely reflected and attenuated. Further, the "resonance chamber" refers to a space in which, during traveling of sound wave of the exhaust gas G between the resonance chamber and the exhaust passage 55, energy of the exhaust gas G is attenuated due to interference of the sound waves, thereby to convert the energy of the sound waves to thermal energy, unlike the expansion chamber that forms a portion of the exhaust passage 55. The resonance chamber may be substantially a space having a dead end so as to allow sound wave to travel in the space, and may have a portion that communicates with another chamber. Further, a "muffler chamber" includes both the expansion chamber and the resonance chamber.

Figure 3:
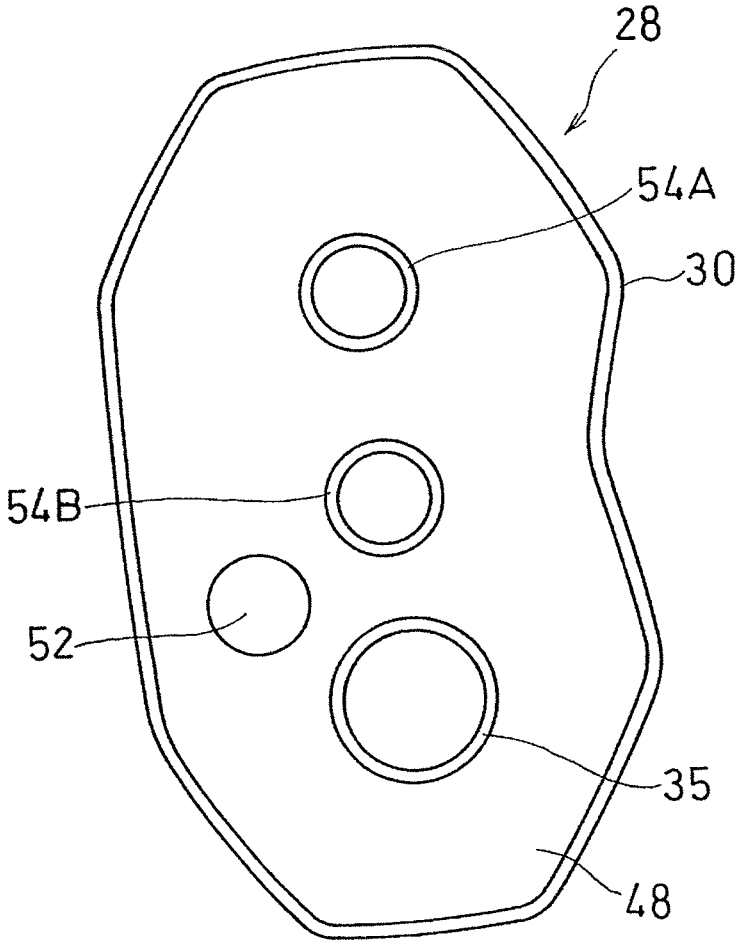
FIG. 3 is a cross-sectional view as taken along a line III-III in FIG. 2.

The inlet pipe 35 connected to the rear end of the merging exhaust pipe 25 (FIG. 1) is inserted from the inlet 38 into the exhaust muffler device 28. The inlet pipe 35 passes through the second expansion chamber 34 without communicating with the second expansion chamber 34, and penetrates through the first partition wall 48, to communicate with the first expansion chamber 32. The inlet pipe 35 is fixed to the first partition wall 48 by welding. As shown in FIG. 3, the first partition wall 48 is provided with a through hole 52 through which the first expansion chamber 32 and the second expansion chamber 34 communicate with each other.

In the first partition wall 48, two first discharge pipes 54A, 54B through which the second expansion chamber 34 communicates with the outside are provided. As shown in FIG. 2, the first discharge pipes 54A, 54B penetrate through the first partition wall 48, and pass through the first expansion chamber 32 without communicating with the first expansion chamber 32. Further, the first discharge pipes 54A, 54B penetrate through the second partition wall 50, and pass through the resonance chamber 36, to communicate with the outside of the exhaust muffler device 28. The first discharge pipes 54A, 54B are fixed to the first partition wall 48 and the second partition wall 50 by welding. One of the first discharge pipes, which is the first discharge pipe 54A on the upper side, is formed as a straight pipe, and the other of the first discharge pipes, which is the first discharge pipe 54B on the lower side, is formed as a curved pipe. However, the shapes of the first discharge pipes 54A, 54B are not limited thereto.

The exhaust passage 55 of the exhaust muffler device 28 is formed by internal spaces of the first expansion chamber 32, the through hole 52, the second expansion chamber 34, and the first discharge pipes 54A, 54B. A peripheral wall of each of the first discharge pipes 54A, 54B is provided with a plurality of communication holes 56 that communicate with the resonance chamber 36. That is, the resonance chamber 36 communicates with a downstream end portion of the exhaust passage 55.

An exhaust valve 58 is provided in the second partition wall 50 disposed between the first expansion chamber 32 and the resonance chamber 36. The exhaust valve 58 is opened when pressure in the first expansion chamber 32 rises to a value higher than a predetermined value. In the present embodiment, the exhaust valve 58 is implemented as a back pressure valve that is set so as to be opened when a differential pressure between the first expansion chamber 32 and the resonance chamber 36 in which substantially atmospheric pressure is maintained, reaches a value greater than or equal to a predetermined value.

The major portion of the exhaust valve 58 is disposed in the rear of the second partition wall 50, that is, disposed in the resonance chamber 36. A portion of the exhaust valve 58 is disposed outside the casing 30. The exhaust valve 58 has a valve port 60 such that the valve port 60 does not oppose an outlet of the inlet pipe 35. Specifically, an axis C1 of the inlet pipe 35 is disposed so as not to be aligned with an axis C2 of the exhaust valve 58. Further, the exhaust valve 58 is disposed between the two first discharge pipes 54A and 54B. Thus, a space in the resonance chamber 36 can be effectively used.

The exhaust valve 58 includes: the valve port 60 formed in the second partition wall 50; a valve body 62 that opens and closes the valve port 60; a valve seat 64, provided in the second partition wall 50, on which the valve body 62 is seated when the valve is closed; and a spring member 66 which presses the valve body 62 against the valve seat 64. The spring member 66 is implemented as a coil-like compression spring. The spring member 66 presses the valve body 62 against the valve seat 64 at the front end portion thereof, and the rear end portion of the spring member 66 contacts with a closing member 76 described below, to regulate rearward movement thereof. The valve seat 64 formed as a steel ring is fixed to the second partition wall 50 by welding, and seals the valve port 60, in conjunction with the valve body 62, when the valve is closed.

Thus, the exhaust valve 58 of the present embodiment is a mechanical valve, and the structure thereof is simple, and reliability at a high temperature and/or under a high pressure is high. Further, since the exhaust valve 58 is disposed on the resonance chamber 36 side, the spring member 66 is protected from the exhaust gas G, in the first expansion chamber 32, having a high temperature.

The exhaust valve 58 further includes: a spring case 70 that forms a spring accommodation chamber 68 therein; and a valve case 69 in which the valve body 62 moves. The spring accommodation chamber 68 accommodates the spring member 66 therein. The valve case 69 is concentric with the spring case 70, and has an outer diameter that is greater than a diameter of the spring case 70.

The valve case 69 and the spring case 70 are each formed into a tubular shape, and these cases 69 and 70 are made of a single steel material. A stepped portion 72 is formed between the valve case 69 and the spring case 70. A flange portion 74 is formed into a flange-like shape at the end portion on the valve case 69 side, that is, in the front side end portion of the valve case 69. The valve case 69 is fixed to the second partition wall 50 through the flange portion 74 by welding. The closing member 76 is fixed, by welding, to the end portion on the spring case 70 side, that is, in the rear side end portion of the spring case 70. That is, the rear end portion of the spring accommodation chamber 68 is closed. The rear end portion of the spring member 66 is fixed to and held by the closing member 76.

The spring accommodation chamber 68 is exposed to the outside of the exhaust muffler device 28. In the present embodiment, substantially the entirety of the spring accommodation chamber 68 is exposed to the outside of the exhaust muffler device 28. However, at least a portion of the spring accommodation chamber 68 may be exposed to the outside of the exhaust muffler device 28.

Figure 4:
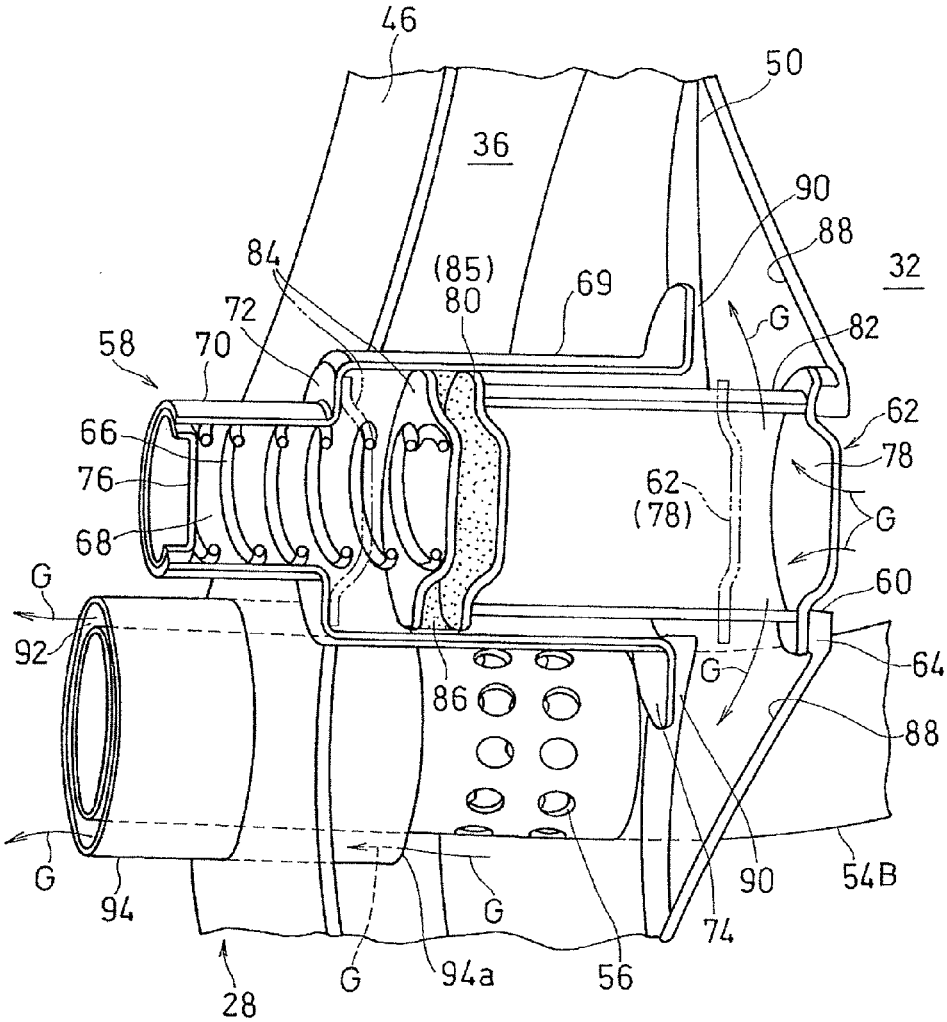
FIG. 4 is a longitudinal cross-sectional view of an exhaust valve of the exhaust muffler device.

As shown in FIG. 4, the valve body 62 includes: a valve seat contact plate 78, disposed in the front end portion thereof, which is seated on the valve seat 64 to close the valve port 60; and a spring member contact plate 80 disposed in the rear end portion on the spring member 66 side. The valve seat contact plate 78 and the spring member contact plate 80 are connected to each other by a cylindrical connecting member 82. In other words, the connecting member 82 has a tubular shape that is coaxial with the spring member 66, and both ends of the connecting member 82 are closed by the valve seat contact plate 78 and the spring member contact plate 80.

The spring member contact plate 80 has an outer diameter that is greater than outer diameters of the connecting member 82 and the spring case 70, and that is slightly less than an inner diameter of the valve case 69. That is, the spring member contact plate 80 acts as an inflow preventing member 85 that prevents the exhaust gas G from flowing into the spring accommodation chamber 68. The inflow preventing member 85 is disposed in the valve case 69, and prevents the exhaust gas from flowing into the spring accommodation chamber 68 at least when the valve is opened. The inflow preventing member 85 of the present embodiment prevents the exhaust gas G from flowing into the spring accommodation chamber 68 also when the valve is closed. The spring member contact plate 80 is guided by the inner peripheral surface of the valve case 69 to move when the valve body 62 operates.

A spring receiver plate 84 having an outer diameter greater than the diameter of the spring case 70 is provided in the front end portion of the spring member 66. The spring receiver plate 84 contacts with the spring member contact plate 80 of the valve body 62 through a heat insulation material 86. The heat insulation material 86 is, for example, a ceramic fiber. That is, the spring member contact plate 80 of the valve body 62 indirectly contacts with the spring member 66 through the heat insulation material 86 and the spring receiver plate 84, and the spring receiver plate 84 contacts with the valve body 62 through the heat insulation material 86. The spring receiver plate 84 also forms the inflow preventing member 85 together with the spring member contact plate 80. However, one of the spring receiver plate 84 and the spring member contact plate 80 may not be provided.

Figure 5:
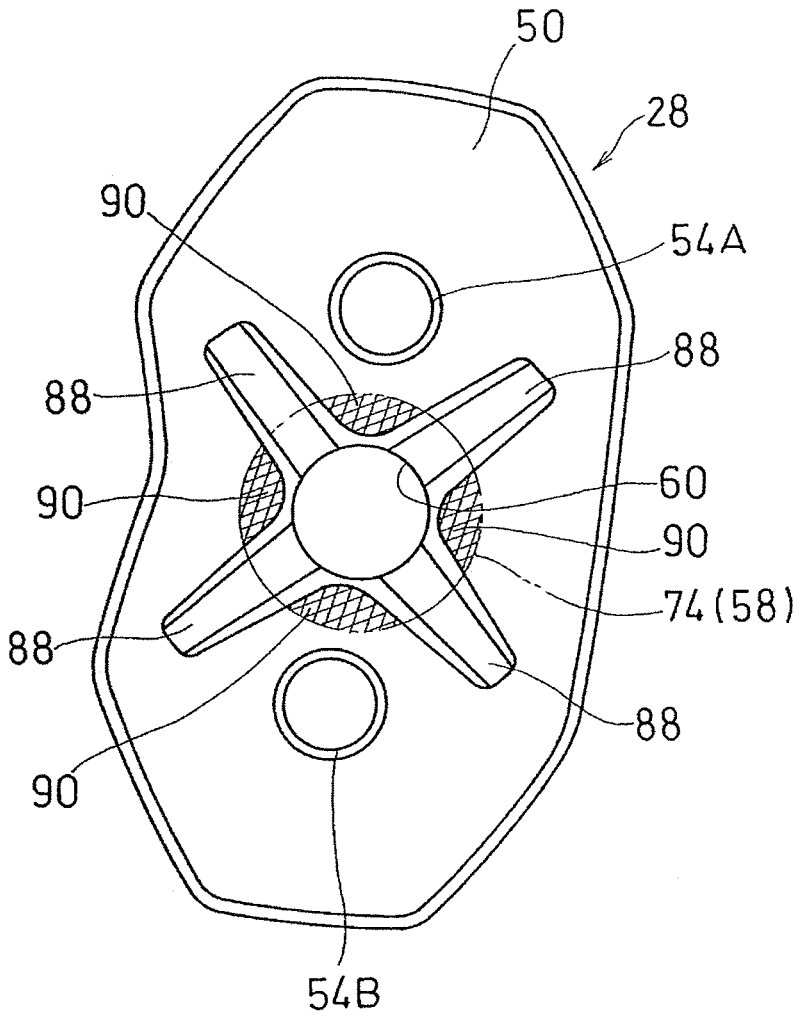
FIG. 5 is a cross-sectional view as taken along a line V-V in FIG. 2.

A plurality of introduction passages 88, through which the exhaust gas G passing through the valve port 60 is introduced into the resonance chamber 36 when the valve is opened, are formed around the valve seat 64 at the second partition wall 50. The introduction passages 88 are implemented as grooves formed in the second partition wall 50, and each have a tilted surface that is tilted rearward from the valve port 60 towards the radial outside. As shown in FIG. 5, in the present embodiment, the four introduction passages 88 are aligned in the circumferential direction.

A valve case fixing portion 90, which is not recessed and to which the valve case 69 is fixed, is formed among the introduction passages 88 at the second partition wall 50. In FIG. 5, the valve case fixing portion 90 is indicated by cross-hatching. The flange portion 74 of the valve case 69 shown in FIG. 4 is attached to the valve case fixing portion 90 of the second partition wall 50. The valve case fixing portion 90 is raised rearward from the introduction passages 88, and thus acts also as a regulation member that regulates movement of the valve body 62 in the radial direction.

The exhaust muffler device 28 has discharge passages 92, and the exhaust gas G, which flows from the first expansion chamber 32 shown in FIG. 2 through the exhaust valve 58 into the resonance chamber 36, is discharged to the outside via the discharge passages 92. The discharge passages 92 are formed by second discharge pipes 94 through which the resonance chamber 36 communicates with the outside. The second discharge pipes 94 penetrate through the rear wall 46 of the exhaust muffler device 28. The resonance chamber 36 is disposed adjacent to the rear wall 46 of the exhaust muffler device 28, whereby the second discharge pipes 94 can be shortened. Thus, the resonance chamber 36 communicates with the outside through the second discharge pipes 94, whereby substantially atmospheric pressure is maintained in the resonance chamber 36. Therefore, a difference in pressure between the first expansion chamber 32 and the resonance chamber 36 in which substantially atmospheric pressure is maintained, is increased, whereby differential pressure is likely to be increased.

The second discharge pipes 94 are disposed so as to be concentric with the first discharge pipes 54A, 54B, and are formed so as to cover the first discharge pipes 54A, 54B from the radially outer side. That is, double pipes are formed by the second discharge pipes 94 and the first discharge pipes 54A, 54B. When such a double pipe is used, the exhaust outlet becomes compact. Discharge pipe inlets 94*a* that are upstream ends of the second discharge pipes 94 are positioned downstream (rearward) of the communication holes 56 in the first discharge pipes 54A, 54B.

An operation of the exhaust muffler device 28 of the present invention will be described. When the combustion engine E shown in FIG. 1 starts to operate, the exhaust gas G flows through the exhaust pipes 26, the merging exhaust pipe 25, the exhaust chamber 27 and the inlet pipe 35 into the first expansion chamber 32 of the exhaust muffler device 28 shown in FIG. 2, and the exhaust gas G is expanded, thereby to be muffled. Further, the exhaust gas G, which has flowed into the first expansion chamber 32, flows through the through hole 52 into the second expansion chamber 34, and the exhaust gas G is expanded, thereby to be muffled. At this time, a flow direction in which the exhaust gas G flows out towards the second expansion chamber 34 is opposite to a flow direction in which the exhaust gas G flows into the first expansion chamber 32. Thus, muffling effect is enhanced.

The exhaust gas G that has flowed into the second expansion chamber 34 is discharged through the first discharge pipes 54A, 54B to the outside. At this time, a flow direction in which the exhaust gas G flows out to the first discharge pipes 54A, 54B is opposite to the flow direction in which the exhaust gas G flows into the second expansion chamber 34. Thus, the muffling effect is enhanced. A portion of the exhaust gas G that flows in the first discharge pipes 54A, 54B flows into the resonance chamber 36 through the communication holes 56. In the resonance chamber 36, sound of the exhaust gas G that flows through the communication holes 56 is muffled due to resonance.

When an engine output becomes high, and a difference in internal pressure between the first expansion chamber 32 and the resonance chamber 36 attains a value greater than a predetermined value, the valve body 62 of the exhaust valve 58 is moved rearward so as to be away from the valve seat 64 as indicated by a double dotted line in FIG. 4, and enters an opened state. When the exhaust valve 58 is opened, the exhaust gas G in the first expansion chamber 32 shown in FIG. 2 flows through the valve port 60 into the resonance chamber 36. The exhaust gas G that has flowed into the resonance chamber 36 is expanded in the resonance chamber 36 to muffle sound thereof, and is then discharged through the discharge passages 92 provided between the first discharge pipes 54A, 54B and the second discharge pipes 94 to the outside.

In the above configuration, when pressure in the first expansion chamber 32 is increased, the exhaust valve 58 is opened, and a portion of the exhaust gas G flows into the resonance chamber 36. Thus, the exhaust muffler device 28 is protected from the high-pressure exhaust gas G. At this time, a portion of the exhaust gas G is discharged through the resonance chamber 36 and the discharge passages 92 to the outside, and a remaining portion of the exhaust gas G is discharged through the exhaust passage 55 to the outside. That is, in a low pressure state where the exhaust valve 58 is closed, the exhaust gas G is discharged through the exhaust passage 55 to the outside. In a high pressure state where the exhaust valve 58 is opened, the exhaust gas G is discharged through both the discharge passages 92 and the exhaust passage 55 to the outside.

Further, the communication holes 56 are formed in the peripheral walls of the first discharge pipes 54A, 54B so as to communicate with the resonance chamber 36. Therefore, the muffler chamber can be used as the resonance chamber when the valve is closed. As a result, muffling effect is enhanced when the pressure of the exhaust gas G is low.

As described above, a space, used as the resonance chamber 36 when the valve is closed, is used as the expansion chamber and a relief passage when the pressure is high, whereby the exhaust gas G can be effectively discharged even when the pressure is high without increasing diameters of the first discharge pipes 54A, 54B. As a result, muffling effect can be sufficient when the exhaust valve 58 is closed, and a high engine output can be assured when the valve is opened.

The resonance chamber 36 communicates with the downstream end portion for the exhaust passage 55 shown in FIG. 2. Thus, the upstream end and the downstream end of the exhaust passage 55 communicate with each other through the resonance chamber 36. Therefore, the second expansion chamber 34 can be bypassed when the valve is opened.

The exhaust muffler device 28 is formed such that a cross-sectional area is gradually increased from the front end toward the rear end. Therefore, the resonance chamber 36 is disposed at the rear end of the exhaust muffler device 28, whereby the capacity of the resonance chamber 36 can be increased without increasing a dimension, of the resonance chamber 36, in the longitudinal direction. As a result, resonance effect of the resonance chamber 36 can be enhanced, while increasing of a dimension, of the exhaust muffler device 28, in the longitudinal direction is suppressed.

The exhaust valve 58 is disposed not on the first expansion chamber 32 side but on the resonance chamber 36 side. Therefore, the valve body 62 of the exhaust valve 58, except a top valve face, can be prevented from being exposed to exhaust gas, in the first expansion chamber 32, having a high temperature.

A portion of the exhaust valve 58 is disposed outside the exhaust muffler device 28, whereby increasing of temperature of the exhaust valve 58 can be suppressed.

The resonance chamber 36 is disposed adjacent to the rear wall 46 of the exhaust muffler device 28, and the discharge passages 92 are formed so as to penetrate through the rear wall 46. Therefore, the discharge passages 92 can be shortened, and the structure of the exhaust muffler device 28 is simplified.

The discharge passages 92 are formed as double pipes formed by the first discharge pipes 54A, 54B and the second discharge pipes 94. Therefore, the discharge passages 92 can be made compact. As shown in FIG. 2, the two discharge passages 92 are provided and the exhaust valve 58 is disposed between the two discharge passages 92, whereby the exhaust gas G is smoothly guided into the discharge passages 92 when the valve is opened.

By the discharge passages 92 being provided, pressure in the resonance chamber 36 can be prevented from being excessively high. Thus, a differential pressure between the first expansion chamber 32 and the resonance chamber 36 is increased, whereby the exhaust valve 58 that is opened according to the differential pressure can be advantageously used.

At least a portion of the spring accommodation chamber 68, in which the spring member 66 shown in FIG. 4 is accommodated, is exposed to the outside of the exhaust muffler device 28. Thus, the spring member 66 is less likely to be exposed to high temperature, and cooled by outside air. As a result, a material of the spring member 66 can be selected from an increased variety of options, to enhance a degree of freedom for designing. In particular, a portion of the spring accommodation chamber 68, at which the spring member 66 is held, and a portion of the spring accommodation chamber 68, with which the spring member 66 directly contacts, are exposed to the outside of the exhaust muffler device 28, whereby increase of temperature of the spring member can be effectively suppressed.

The inflow preventing member 85 that prevents exhaust gas from flowing into the spring accommodation chamber 68 is disposed between the valve body 62 and the spring member 66. Thus, the exhaust gas G having a high temperature can be prevented from flowing into the spring accommodation chamber 68, whereby the spring member 66 is less likely to be exposed to a high temperature. Further, the inflow preventing member 85 is disposed in the valve case 69, and covered by the valve case 69, whereby the inflow preventing member 85 is not directly exposed to the exhaust gas G in the resonance chamber 36.

As indicated by a double dotted lines or phantom lines in FIG. 4, when the valve is opened, the spring receiver plate 84 contacts with the stepped portion 72 between the spring case 70 and the valve case 69, to act as a stopper for the valve body 62. Thus, the stopper can be formed in a simple structure.

Further, the spring member contact plate 80 and the valve seat contact plate 78 are spaced from each other such that the connecting member 82 is disposed therebetween. Therefore, transmission of heat from the exhaust gas G to the spring member contact plate 80 can be reduced. As a result, transmission of heat from the spring member contact plate 80 through the spring receiver plate 84 to the spring member 66 can be reduced, whereby increasing of temperature of the spring member 66 can be suppressed. Furthermore, the connecting member 82 has a tubular shape, and is closed at both ends thereof by the spring member contact plate 80 and the valve seat contact plate 78. Thus, an air layer is formed in the connecting member 82, whereby transmission of heat from the exhaust gas to the spring member contact plate 80 can be further reduced.

Further, the heat insulation material 86 is interposed between the spring receiver plate 84 and the spring member contact plate 80, whereby increase of temperature of the spring member 66 can be further suppressed. Further, the spring member contact plate 80 concurrently functions as the inflow preventing member 85 that prevents the exhaust gas G from flowing into the spring accommodation chamber 68, whereby the inflow preventing member 85 can be implemented in a simple structure.

The valve case 69 is fixed to the second partition wall 50, and the connecting member 82 and the spring member contact plate 80 are guided by the inner peripheral surface of the valve case 69 to move. Thus, the valve case 69 is used as a guide for the valve body 62, whereby the valve body 62 can be smoothly opened and closed.

The plurality of introduction passages 88, through which the exhaust gas G passing through the valve port 60 is introduced into the resonance chamber 36 when the valve is opened, are formed around the valve seat 64 at the second partition wall 50. Thus, the exhaust gas G is smoothly introduced into the resonance chamber 36, and guided to the discharge passages 92.

The four introduction passages 88 shown in FIG. 5 are aligned in the circumferential direction, and the valve case fixing portion 90, to which the valve case 69 is fixed, is formed among the four introduction passages 88 at the second partition wall 50. Thus, the valve case fixing portion 90 acts as a regulation member that regulates movement of the valve body 62 in the radial direction. Therefore, the regulation member 90 that regulates movement of the valve body 62 in the radial direction, and the introduction passages 88 through which the exhaust gas G is introduced into the resonance chamber 36 can be formed in a simple structure.

Figure 6:
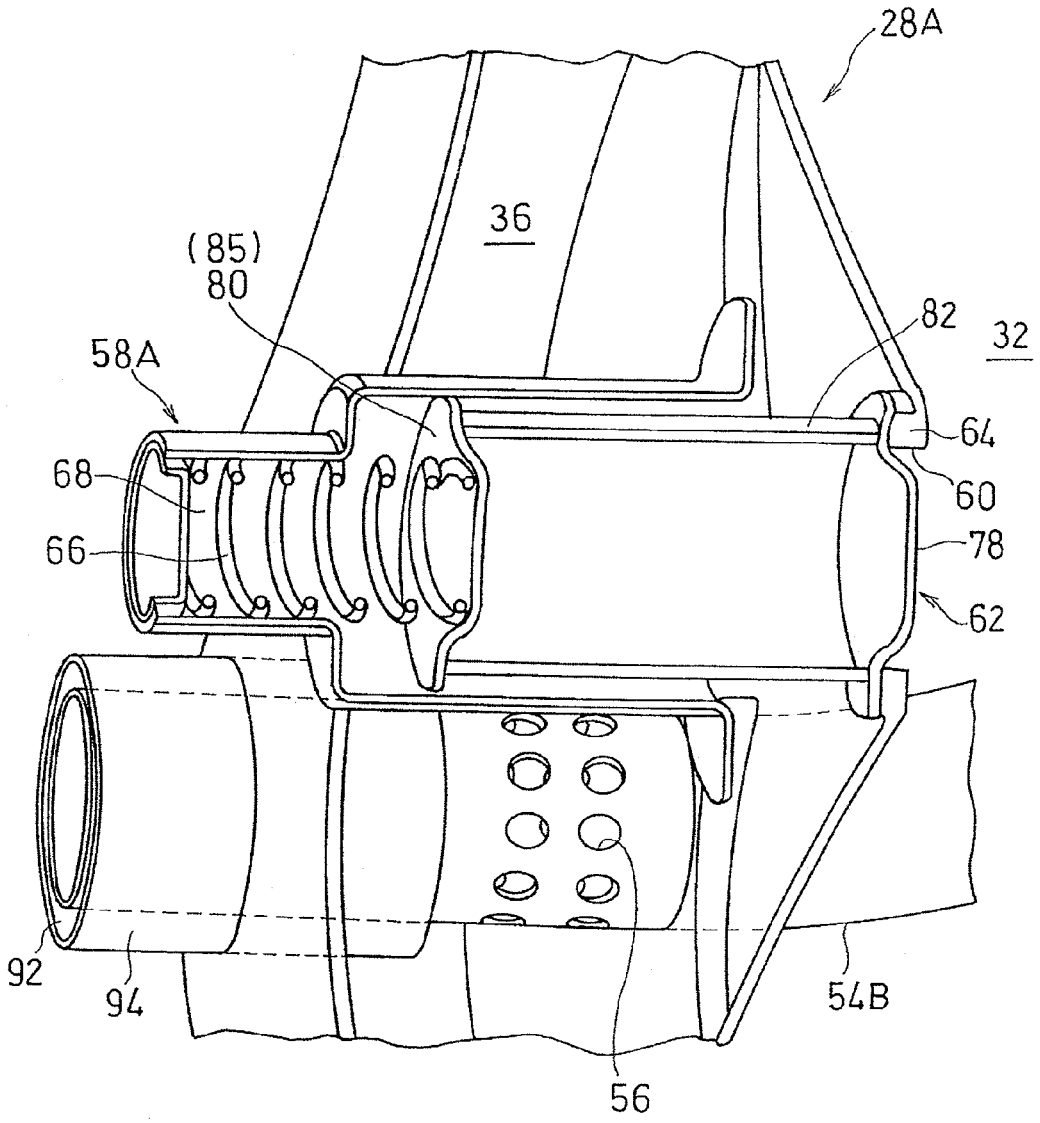
FIG. 6 is a longitudinal cross-sectional view of an exhaust valve of an exhaust muffler device for a combustion engine according to a second preferred embodiment of the present invention.

FIG. 6 is a longitudinal cross-sectional view of an exhaust valve 58A of an exhaust muffler device 28A according to a second preferred embodiment of the present invention. The exhaust valve 58A of the exhaust muffler device 28A according to the second embodiment is different from the exhaust valve 58 according to the first embodiment as shown in FIGS. 1 to 5 in that the exhaust valve 58A does not include the heat insulation material 86, and the other structures are the same therebetween. Specifically, in the exhaust muffler device 28A shown in FIG. 6, the spring member contact plate 80 concurrently functions as the spring receiver plate 84, and the spring member 66 contacts with the spring member contact plate 80. Also in the second embodiment, the same effect as described above for the first embodiment can be obtained. Further, according to the second embodiment, the structure of the exhaust valve 58A can be simplified.

The present invention is not limited to the embodiments described above, and various additions, modifications, or deletions may be made without departing from the gist of the invention. For example, the structures of the exhaust valves 58, 58A are not limited to the structures according to the above embodiments. The exhaust valve may not be a differential pressure valve. Further, the valve body 62 may have a disk-like shape that does not have the connecting member 82. In this case, the valve body can be made compact. Further, the first discharge pipes 54A, 54B may not be provided with the communication holes 56. The present invention can be advantageously used for a supercharged combustion engine that allows an engine output to be enhanced. Therefore, these are construed as included within the scope of the present invention.

With reference to FIG. 1 to FIG. 6, the preferred embodiments of the exhaust muffler devices 28, 28A of the combustion engine E are described. The description also refers to back pressure valves 58, 58A of an exhaust muffler device for a combustion engine according to modes 1 to 13 as described below.

[Mode 1]

A back pressure valve disposed in an exhaust muffler device having two or more muffler chambers into which exhaust gas from a combustion engine flows, the back pressure valve comprising:

a valve seat disposed on a partition wall between one muffler chamber and another muffler chamber that are adjacent to each other;

a valve body;

a spring member configured to press, at one end portion thereof, the valve body against the valve seat, movement of the spring member in an axial direction being regulated at the other end portion thereof; and a spring accommodation chamber configured to accommodate the spring member, wherein at least a portion of the spring accommodation chamber is exposed to an outside of the exhaust muffler device.

[Mode 2]

The back pressure valve according to mode 1, further comprising an inflow preventing member disposed between the valve body and the spring member, and configured to prevent exhaust gas from flowing into the spring accommodation chamber at least when the valve is opened.

[Mode 3]

The back pressure valve according to mode 2, wherein the inflow preventing member prevents exhaust gas from flowing into the spring accommodation chamber when the valve is opened and when the valve is closed.

[Mode 4]

The back pressure valve according to any one of modes 1 to 3, further comprising:

a valve case configured to be concentric with the spring accommodation chamber and to have an outer diameter greater than a diameter of the spring accommodation chamber, the valve case allowing the valve body to move therein;

a spring member contact plate that contacts with the spring member and has an outer diameter greater than the diameter of the spring accommodation chamber, the spring member contact plate being attached to the other end portion of the valve body.

[Mode 5]

The back pressure valve according to any one of modes 1 to 4, wherein at least a portion of the spring accommodation chamber, at which the spring member is held, is exposed to the outside of the exhaust muffler device.

[Mode 6]

The back pressure valve according to any one of modes 1 to 5, wherein the valve body includes: a spring member contact plate provided at the other end portion thereof, and configured to contact directly or indirectly with the spring member; a valve seat contact plate provided at one end portion thereof and configured to contact with the valve seat; and a connecting member that connects between the spring member contact plate and the valve seat contact plate.

[Mode 7]

The back pressure valve according to mode 6, further comprising a spring receiver plate configured to contact with the one end portion of the spring member and contact with the valve body, wherein at least one of the spring receiver plate and the spring member contact plate acts as an inflow preventing member that prevents exhaust gas from flowing into the spring accommodation chamber.

[Mode 8]

The back pressure valve according to mode 7, further comprising a heat insulation material interposed between the spring receiver plate and the spring member contact plate.

[Mode 9]

The back pressure valve according to mode 7 or 8, further comprising a valve case configured to be concentric with the spring accommodation chamber and to have an outer diameter greater than a diameter of the spring accommodation chamber, the valve case allowing the valve body to move therein, wherein the inflow preventing member is disposed inside the valve case.

[Mode 10]

The back pressure valve according to any one of modes 6 to 9, wherein the connecting member has a tubular shape that is concentric with the spring member, and the connecting member is closed, at both ends thereof, by the spring member contact plate and the valve seat contact plate.

[Mode 11]

The back pressure valve according to mode 9, wherein the valve case is fixed to the partition wall, and the spring member contact plate is guided by an inner peripheral surface of the valve case, to move.

[Mode 12]

The back pressure valve according to mode 11, further comprising a plurality of introduction passages through which exhaust gas that passes through a valve port is introduced into the muffler chamber when the valve is opened, the introduction passages being formed around the valve seat at the partition wall.

[Mode 13]

The back pressure valve according to mode 12, wherein the plurality of introduction passages are aligned in a circumferential direction, a valve case fixing portion to which the valve case is fixed is formed among the plurality of introduction passages at the partition wall, and the valve case fixing portion acts as a regulation member that regulates movement of the valve body in a radial direction.

REFERENCE NUMERALS

28, 28A . . . exhaust muffler device
30 . . . casing
32 . . . first expansion chamber (expansion chamber on upstream side)
34 . . . second expansion chamber
36 . . . resonance chamber (muffler chamber)
50 . . . second partition wall (partition wall)
54A, 54B . . . first discharge pipe
55 . . . exhaust passage
56 . . . communication hole
58, 58A . . . exhaust valve
92 . . . discharge passage
94 . . . second discharge pipe
94*a* . . . discharge pipe inlet
E . . . combustion engine
G . . . exhaust gas

What is claimed is:

1. An exhaust muffler device comprising an expansion chamber into which exhaust gas from a combustion engine flows, the exhaust muffler device comprising an exhaust passage configured to discharge the exhaust gas through the expansion chamber to an outside of the exhaust muffler device;

a muffler chamber disposed adjacent to the expansion chamber;

a discharge passage configured to discharge the exhaust gas from the muffler chamber to the outside of the exhaust muffler device; and an exhaust valve disposed in a partition wall between the expansion chamber and the muffler chamber, and configured to open when pressure in the expansion chamber attains a value greater than a predetermined value, wherein the exhaust valve includes:

a valve seat disposed on the partition wall;

a valve body;

a spring member configured to press, at one end portion thereof, the valve body against the valve seat, movement of the spring member in an axial direction being regulated at the other end portion thereof;

a spring accommodation chamber configured to accommodate the spring member;

at least a portion of the spring accommodation chamber is exposed to an outside of the exhaust muffler device;

a valve case configured to be concentric with the spring accommodation chamber and to have an outer diameter greater than a diameter of the spring accommodation chamber, the valve case allowing the valve body to move therein;

a spring member contact plate that contacts with the spring member and has an outer diameter greater than the diameter of the spring accommodation chamber, the spring member contact plate being attached to the other end portion of the valve body; and a portion of the exhaust passage is formed by a pipe member, and a communication hole is formed in a peripheral wall of the pipe member so as to communicate with the muffler chamber.

2. The exhaust muffler device as claimed in claim 1, wherein the pipe member is formed by a first discharge pipe, which is provided in a downstream end portion of the exhaust passage and extends from the expansion chamber through the muffler chamber to communicate with the outside.

3. The exhaust muffler device as claimed in claim 1, wherein two or more of expansion, chambers are provided, and the muffler chamber is disposed adjacent to an upstream side expansion chamber which receives the exhaust gas from the combustion engine and communicates with a downstream end portion of the exhaust passage.

4. The exhaust muffler device as claimed in claim 3, comprising a casing in which the two or more expansion chambers and the muffler chamber are formed, wherein the casing has a tubular shape having a longitudinal direction, in which the exhaust gas flows into the casing on one end side in the longitudinal direction, the exhaust gas is discharged from the casing on the other end side in the longitudinal direction, and a cross-sectional area is gradually increased from the one end side toward the other end side over an entire length in the longitudinal direction, and the muffler chamber is disposed on the other end side in the longitudinal direction and includes both an expansion chamber and a resonance chamber.

5. The exhaust muffler device as claimed in claim 1, wherein the exhaust valve is disposed in the muffler chamber.

6. The exhaust muffler device as claimed in claim 1, wherein a portion of the exhaust valve is disposed outside a casing of the exhaust muffler device.

7. An exhaust muffler device comprising an expansion chamber into which exhaust gas from a combustion engine flows, the exhaust muffler device comprising:

an exhaust passage configured to discharge the exhaust gas through the expansion chamber to an outside of the exhaust muffler device;

a muffler chamber disposed adjacent to the expansion chamber;

a discharge passage configured to discharge the exhaust gas from the muffler chamber to the outside of the exhaust muffler device; and an exhaust valve disposed in a partition wall between the expansion chamber and the muffler chamber, and configured to open when pressure in the expansion chamber attains a value greater than a predetermined value, wherein a downstream end portion of the exhaust passage is formed by a first discharge pipe that extends from the expansion chamber through the muffler chamber to communicate with the outside, the discharge passage is formed by a second discharge pipe that allows the muffler chamber to communicate with the outside of the exhaust muffler device, a communication hole is formed in a peripheral wall of the first discharge pipe so as to communicate with the muffler chamber, and the second discharge pipe is formed so as to cover the first discharge pipe from a radially outer side, and an inlet of the second discharge pipe is positioned downstream of the communication hole in the first discharge pipe.

8. The exhaust muffler device as claimed in claim 1, wherein the exhaust valve further includes an inflow preventing member disposed between the valve body and the spring member, and configured to prevent exhaust gas from flowing into the spring accommodation chamber at least when the valve is opened.

9. The exhaust muffler device as claimed in claim 8, wherein the inflow preventing member prevents exhaust gas from flowing into the spring accommodation chamber when the valve is opened and when the valve is closed.

10. The exhaust muffler device as claimed in claim 1, wherein at least a portion of the spring accommodation chamber, at which the spring member is held, is exposed to the outside of the exhaust muffler device.

11. An exhaust muffler device comprising;

an expansion chamber into which exhaust gas from a combustion engine flows, an exhaust passage configured to discharge the exhaust gas through the expansion chamber to an outside of the exhaust muffler device;

a muffler chamber disposed adjacent the expansion chamber;

a discharge passage configured to discharge the exhaust gas from the muffler chamber to the outside of the exhaust muffler device; and an exhaust valve disposed in a partition wall between the expansion chamber and the muffler chamber, and configured to open when pressure in the expansion chamber attains a value greater than a predetermined value wherein the exhaust valve includes;

a valve seat disposed on the partition wall;

a valve body;

a spring member configured to press, at one end portion thereof, the valve body against the valve seat, movement of the spring member in an axial direction being regulated at the other end portion thereof;

a spring accommodation chamber configured to accommodate the spring member;

at least a portion of the spring accommodation chamber is exposed to an outside of the exhaust device;

wherein the valve body includes:

a spring member contact plate provided at the other end portion thereof, and configured to contact directly or indirectly with the spring member;

a valve seat contact plate provided at one end portion thereof and configured to contact with the valve seat; and a connecting member that connects between the spring member contact plate and the valve seat contact plate.

* * * * *